US005306221A

United States Patent [19]

Itaru

[11] Patent Number: 5,306,221

[45] Date of Patent: Apr. 26, 1994

[54] WEIGHT ADJUSTING DEVICE FOR MUSCLE TRAINING MACHINE

[76] Inventor: Abe Itaru, 169-1 Takamatsu, Sakaiminato, Tottori, Japan

[21] Appl. No.: 991,289

[22] Filed: Dec. 15, 1992

[51] Int. Cl.[5] ..... A63B 21/062

[52] U.S. Cl. ..... 482/98; 482/97

[58] Field of Search ..... 482/98, 99, 100, 101, 482/102, 103, 97, 908, 75, 42

[56] References Cited

U.S. PATENT DOCUMENTS

| | | | |
|---|---|---|---|
| 1,053,109 | 2/1913 | Reach | 482/99 |
| 3,257,111 | 6/1966 | Martin | 482/98 |
| 4,546,970 | 10/1985 | Mahnke | 482/98 |
| 4,606,540 | 8/1986 | Chin-Sen | 482/98 |
| 4,610,449 | 9/1986 | Diercks, Jr. | 482/98 |
| 4,627,615 | 12/1986 | Nurkowski | 482/98 |
| 4,787,628 | 11/1988 | Harwick et al. | 482/98 |
| 4,974,837 | 12/1990 | Someya et al. | 482/98 |

FOREIGN PATENT DOCUMENTS 1-308576 12/1989 Japan .

*Primary Examiner*—Richard J. Apley
*Assistant Examiner*—Lynne A. Reichard
*Attorney, Agent, or Firm*—Kanesaka & Takeuchi

[57] ABSTRACT

A weight adjusting device (1) for a muscle training machine, which includes a hanger bar (30); weight plates (31) having a vertical central aperture for receiving the hanger bar; latch levers (32) attached to the weight plates for rotation in a horizontal plane between a release position and a latch position; lock levers (35) attached to the weight plates for rotation in a vertical plane between a lock position and an unlock position; spring means (3) placed between the latch lever and the weight plate so as to urge the latch lever toward the release position; interlocking arms (37) extending upwardly from a rear potion of the latch lever so as to contact another latch lever above the latch lever at right angles; latch notches (2) formed on a circumference of the hanger bar; and latch recesses (7) formed on the latch levers so as to engage the latch notches on opposite sides thereof when the latch lever is moved towards the latch position against the spring means.

2 Claims, 11 Drawing Sheets

WEIGHT ADJUSTING DEVICE FOR MUSCLE TRAINING MACHINE

BACKGROUND OF THE INVENTION

1. Field of the Invention

The present invention relates generally to muscle training machines and, more particularly, to weight adjusting devices for a muscle training machine.

2. Description of the Background Art

FIG. 11 shows a conventional muscle training machine. In use, the user stands in front of the muscle training machine 30 and pulls the handle 31 to lift the weight plates 33 through a string 32. The bottom weight plate 33 is fastened to a hanger bar 38 with a removable pin 41 which is inserted through horizontal aperture 40 into a latch hole 42 of the hanger bar 38.

The "weight reduction training method" is one of the most effective muscle training methods, wherein the weight is reduced stepwise by reducing the number of weight plates 33 in the course of exercise. In this training method, after the muscles are trained to the limit by pulling up and down the weight plates 33, the lowest weight plate 33 is removed by pulling out the pin 41 to reduce the weight, and the muscles are trained again to the limit with the reduced weight. Then, another weight plate 33 is removed for further muscle training. In this way, a weight plate 33 is removed each time the muscles are trained to the limit.

FIG. 9 shows a weight adjusting device 1 useful for such a muscle training machine as disclosed in Japanese patent application Kokai No. 1-308576. The weight adjusting device 1 includes one rectangular base 33 and four rectangular weight plates 31*a*–31*d* each having a central aperture for receiving a hanger bar 30 and a pair of apertures for receiving guiding posts 41. The hanger bar 30 is lifted by a hanging means 38.

A latch lever 32 is pivoted to the bottom face of each weight plate 31 for rotation in a horizontal plane. A lock lever 35 is pivoted to the front face of each weight plate 31 for rotation in a vertical plane. The lock levers 35 have a first shoulder 39 and a second shoulder 40 from which a release portion 36 extending downwardly. When it is in a lock position, the lock lever 35 locks the latch lever 32 in the latch position where the latch lever 32 engages the latch notch 34 of the hanger bar 30. When the release portion 36*a* abuts on the latch lever 32*a*, the latch lever 32*b* is released from the first shoulder 39 under the influence of a spring means (not shown) and hits the tip of the release portion 36*b* of the lock lever 35*b*.

In FIG. 10, an L-shaped interlocking arm 37 extends upwardly from the rear end portion of a latch lever 32 such that the upper portion contacts the lower portion of an interlocking arm 37 of the upper latch lever 32. When the lower latch lever 32 is turned counterclockwise toward the hanger bar 30, the interlocking arm 37 pushes the upper latch lever 32 for rotation. As a result, the upper latch lever 32 engages the latch notch 34 of the hanger bar 30 to fasten the weight plate 31 to the hanger bar. Thus, both the latch lever 32 are engaged with the hanger bar 30 by only a single manipulation of the lowest latch lever 32.

However, the amount of engagement between the latch lever 32 and the latch notch 34 is so small that the interlocking arm 37 is not sufficiently brought into contact with the interlocking arm 37 of the upper latch lever 32. Consequently, the rotation of the lower latch lever 32 is not fully transmitted to the upper latch lever 32. Thus, it is difficult to set two or more weight plates 31 on the hanger bar 30 by a single operation of the lowest latch lever 32.

Since the engagement of the latch lever 32 with the latch notch 34 is made on only one side of the hanger bar 30, the weight is offset from the center of gravity of the hanger bar 30. Consequently, the hanger bar 30 is inclined to one side, and the weight plates 31 make frictional contact with the guiding posts 41.

When the lower end of the release portion 36*a* hits the latch lever 32*a* by reducing the pulling force on the hanger string 38, the lock lever 35*a* is turned clockwise so that the latch lever 32*b* is released from the first shoulder 39 of the lock lever 35*a*. When the latch lever 32*b* hits the tip of the release portion 36*b* of the lock lever 35*b*, the lock lever 35*b* is turned clockwise to release the latch lever 32*c* from the latch notch 34. As a result, the two weight plates 31*a* and 31*b* are released simultaneously, making it difficult to practice the weight reduction training method.

Moreover, the bending angle of the L-shaped interlocking arms 37 depends on the length and thickness of the interlocking arms 37, making it complex to set the appropriate bending angle. When the surface of contact with the latch lever 32 varies, it is necessary to make fine adjustments to the bending angle during the manufacturing process, resulting in the increased manufacturing costs.

SUMMARY OF THE INVENTION

Accordingly, it is an object of the invention to provide a weight adjusting device for a muscle training machine, which enables the user to set the desired number of weight plates by a single operation of the latch lever.

It is another object of the invention to provide a weight adjusting device for a muscle training machine, wherein the weight plates are not inclined so much that they make frictional contact with the guiding posts.

It is still another object of the invention to provide a weight adjusting device for a muscle training machine, which prevents accidental simultaneous release of two or more weight plates by a single release operation.

It is yet another object of the invention to provide a weight adjusting device for a muscle training machine, which has an interlocking arm that is easy to be made, thus reducing the manufacturing costs.

According to the invention there is provided a weight adjusting device for a muscle training machine, which includes a hanger bar; at least one guiding post placed parallel to the hanger bar; at least one weight plate having a vertical central aperture for receiving the hanger bar and at least one vertical guiding aperture for receiving the guiding post; a hanging means for lifting the hanger bar; at least one latch lever attached to the weight plate for rotation in a horizontal plane between a release position where the latch lever disengages the hanger bar and a latch position where the latch lever engages the hanger bar; at least one lock lever attached to the weight plate for rotation about a fulcrum in a vertical plane between a lock position where a first shoulder thereof engages the latch lever for locking the latch lever in the latch position and an unlock position where the latch lever is released from the first shoulder toward the release position; at least one spring means placed between the latch lever and the weight plate so as to urge the latch lever toward the release position; at least one interlocking arm extending upwardly from a rear potion of the latch lever so as to contact another latch lever above the latch lever at right angles; at least one latch notch formed on a circumference of the hanger bar; and at least one latch recess formed on the latch lever so as to engage the latch notch on opposite sides thereof when the latch lever is moved towards the latch position against the spring means.

The latch recess engages the latch notch on opposite sides, thereby preventing inclination of the hanger bar. The latch lever engages the hanger bar so deeply that the amount of rotation of the latch lever is sufficiently large to be transmitted by the interlocking arm to the upper latch lever without failure. In addition, since the interlocking arm is attached at right angles to the latch lever such that it contact the upper latch lever in an area other than a portion from which the upper interlocking arm extends upwardly, the above transmission of rotation is further assured. Thus, two or more weight plates are set on the hanger bar without failure by only a single set operation of the lowest latch lever.

When the weight is lowered such an extent that the release portion of a lock lever attached to the lowest weight plate hits the latch lever in the release position, the lock lever is turned clockwise so that the latch lever of the lowest weight plate is released by the spring means from the first shoulder. The released latch lever hits the tip of the release portion of the upper lock lever, urging the upper lock lever against the upper latch lever, thereby assuring the locking the upper latch lever in the latch position. Thus, the accident of simultaneous release of two or more weight plates is prevented.

The above and other objects, features, and advantages of the invention will be more apparent from the following description when taken in conjunction with the accompanying drawings.

DESCRIPTION OF THE PREFERRED EMBODIMENT

Figure 9:
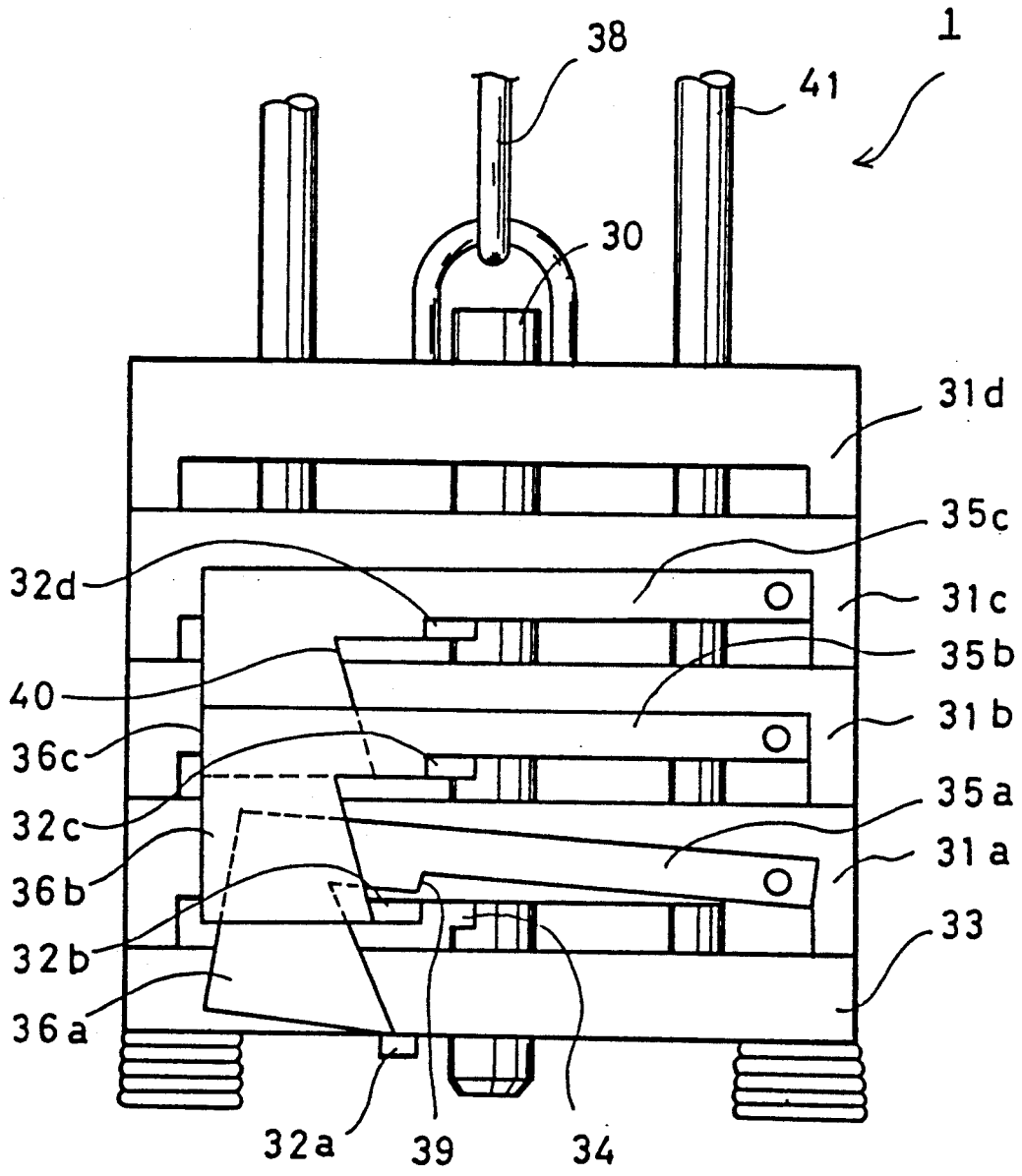
FIG. 9 PRIOR ART
FIG. 9 is a front elevational view of a conventional weight adjusting device.
Figure 10:
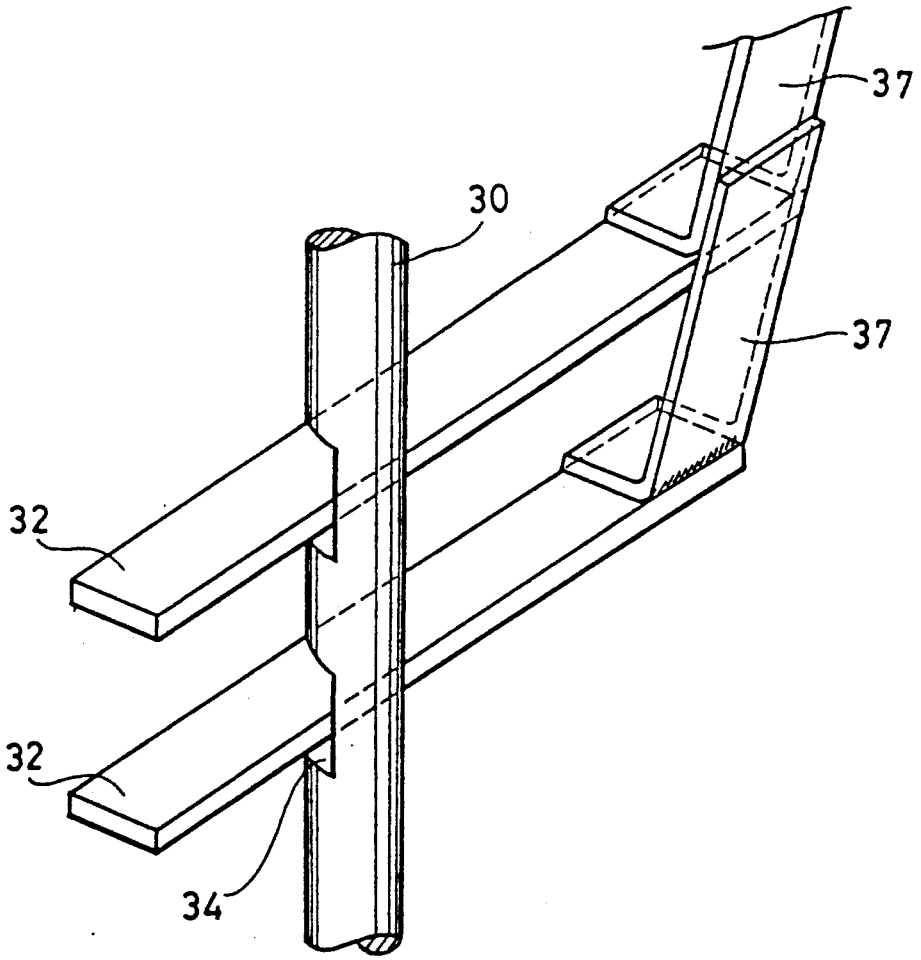
FIG. 10 PRIOR ART
FIG. 10 is a front and upper right perspective view of essential components of the conventional weight adjusting device.
Figure 11:
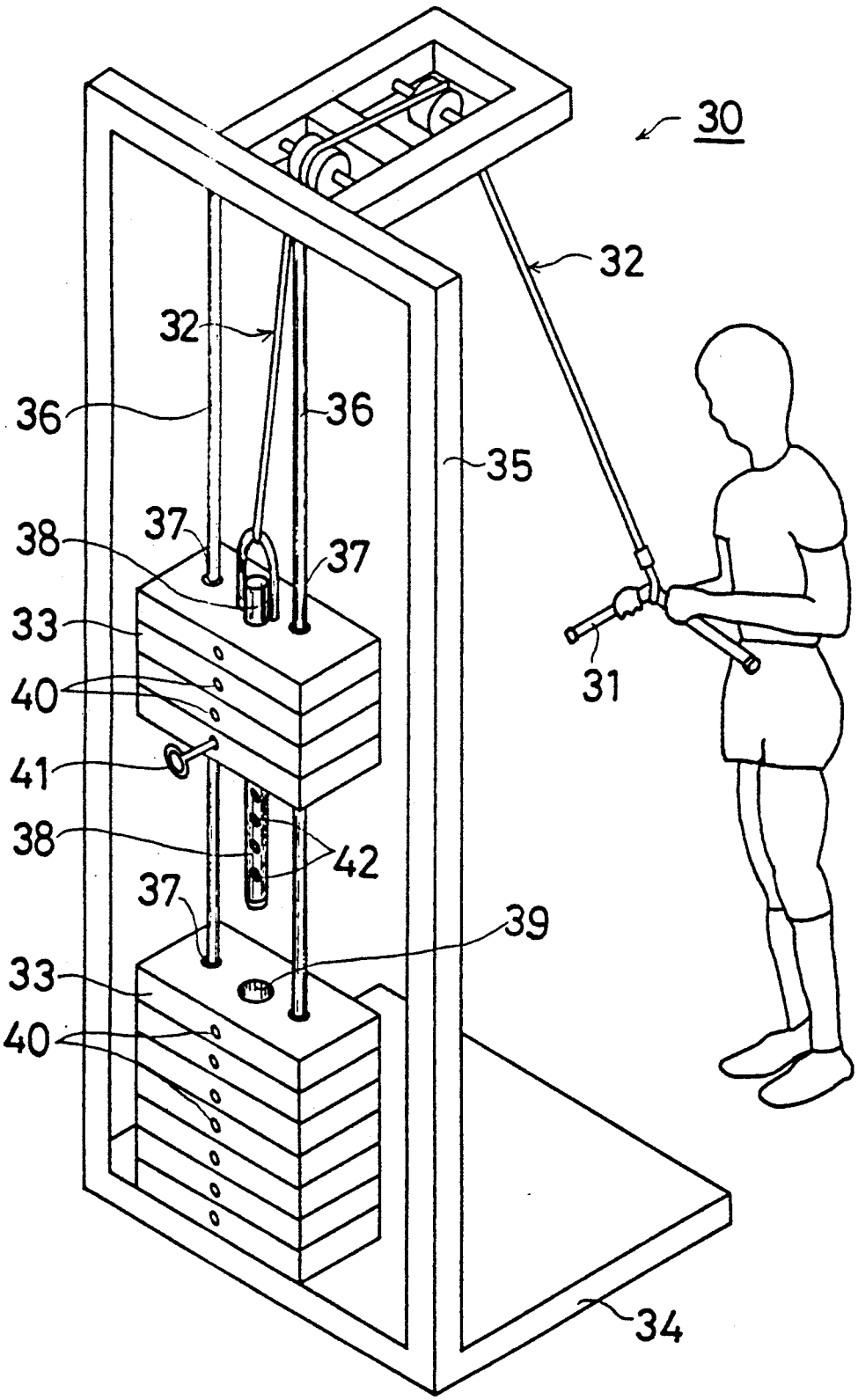
FIG. 11 PRIOR ART
FIG. 11 is a front and upper right perspective view of a conventional muscle training machine.

In FIGS. 1-5, like numeral references indicate like or corresponding parts of FIGS. 9 and 10. The weight adjusting device 1 for a muscle training machine includes four weight plates 31 and a hanger bar 30 having four circumferential notches 2. A latch lever 32 is pivoted to the bottom face of a weight plate 31 for rotation about a fulcrum 6 in a horizontal plane. A tension spring 3 is place between the rear end portion of a latch lever 32 and the rear face 8 of a weight plate 31 for urging the latch lever 32 toward a release position where the latch lever 31 disengages the latch notch 2 of the hanger bar 30. A lock lever 35 is pivoted to the front face 9 of a weight plate 31 for rotation about a fulcrum 10 in a vertical plane to lock the engagement of the latch lever 31 with the latch notch 2. An interlocking arm 37 extends upwardly from the rear end portion of a latch lever 32 for transmitting the rotation of the latch lever 32 to the upper one 32.

A pair of support legs 4 extends downwardly from the side faces of a weight plate 31 to create a space for the latch lever 32 to move. The latch notches 2 are formed by cutting the circumference of the hanger bar 30 at intervals substantially equal to the thickness of weight plates 31. The latch levers 32 have a thickness fitted in the latch notch 2 and a length sufficiently large to project from the front and rear faces of a weight plate 31. Each latch lever 32 has a latch recess 7 which engages the latch notch 2 on opposite sides for fastening the weight plate 31 to the hanger bar 30. The rotation of a latch lever 32 may be improved by putting a washer between the latch lever 32 and the weight plate 31.

The lock levers 35 have a first engaging shoulder 39 and a second engaging shoulder 40 and a release portion 36 extending downwardly from the second engaging shoulder 40 to such an extent that it abuts on the latch lever 32 of the lower weight plate 31. Four compression springs 11 are provided at four corners of the rectangular base 33 to absorb impacts created by the weight plates 31. The lock levers 35 are pivoted at 10 to the front face 9 of a weight plate 31 such that the release portion 36 of a lock lever 35 abuts on the latch lever 32 of the lower weight plate 31. The interlocking arms 37 are made to have a substantially Z-shaped form so that they are brought into contact with the upper latch lever 32 at right angles at an area other than the portion from which the upper interlocking arm 37 extend upwardly. Since the latch recess 7 engages the latch notch 2 so deep that the interlocking arm 37 is able to transmit the rotation to the upper latch lever 32 without failure.

Figure 1:
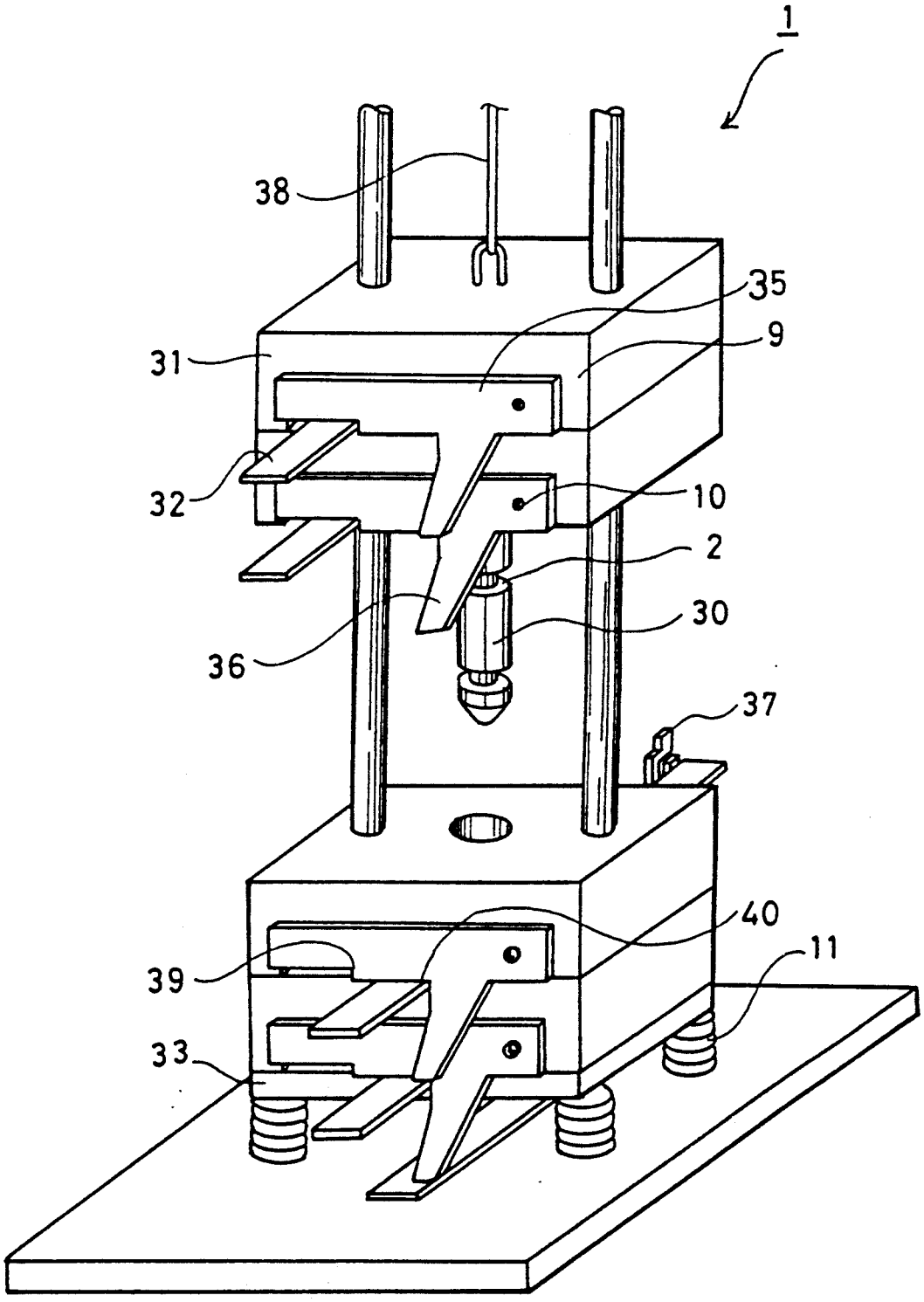
FIG. 1 is a front and upper right perspective view of a weight adjusting device according to an embodiment of the invention.
Figure 2:
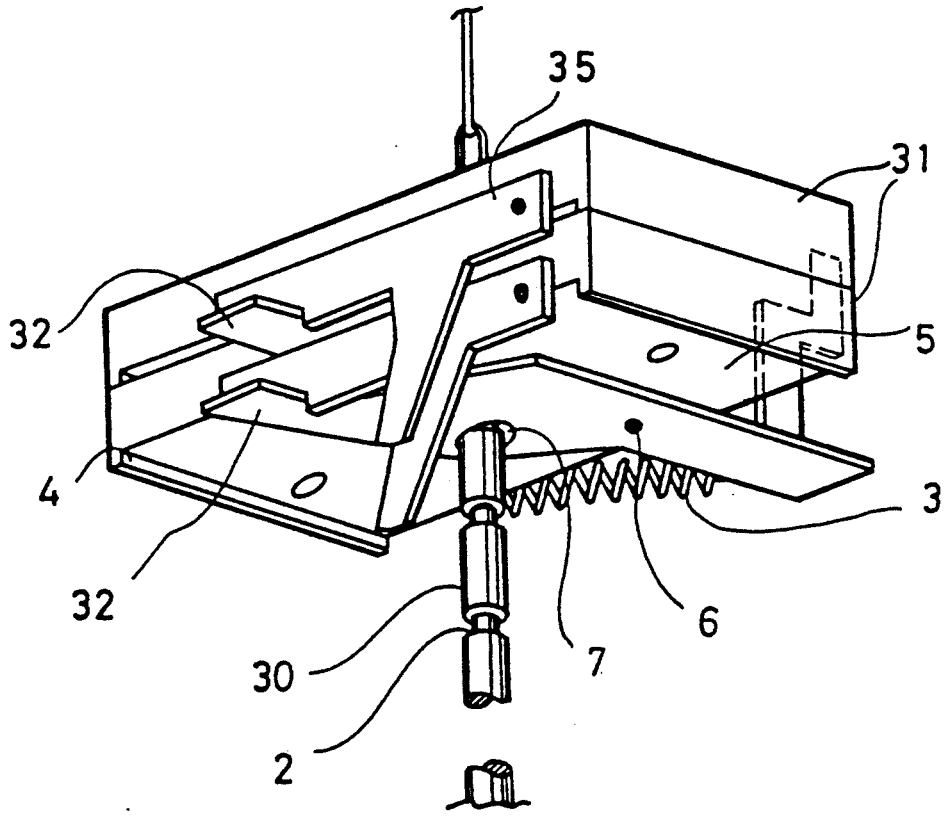
FIG. 2 is a front and lower right perspective view of a weight plate assembly for the weight adjusting device.
Figure 3:
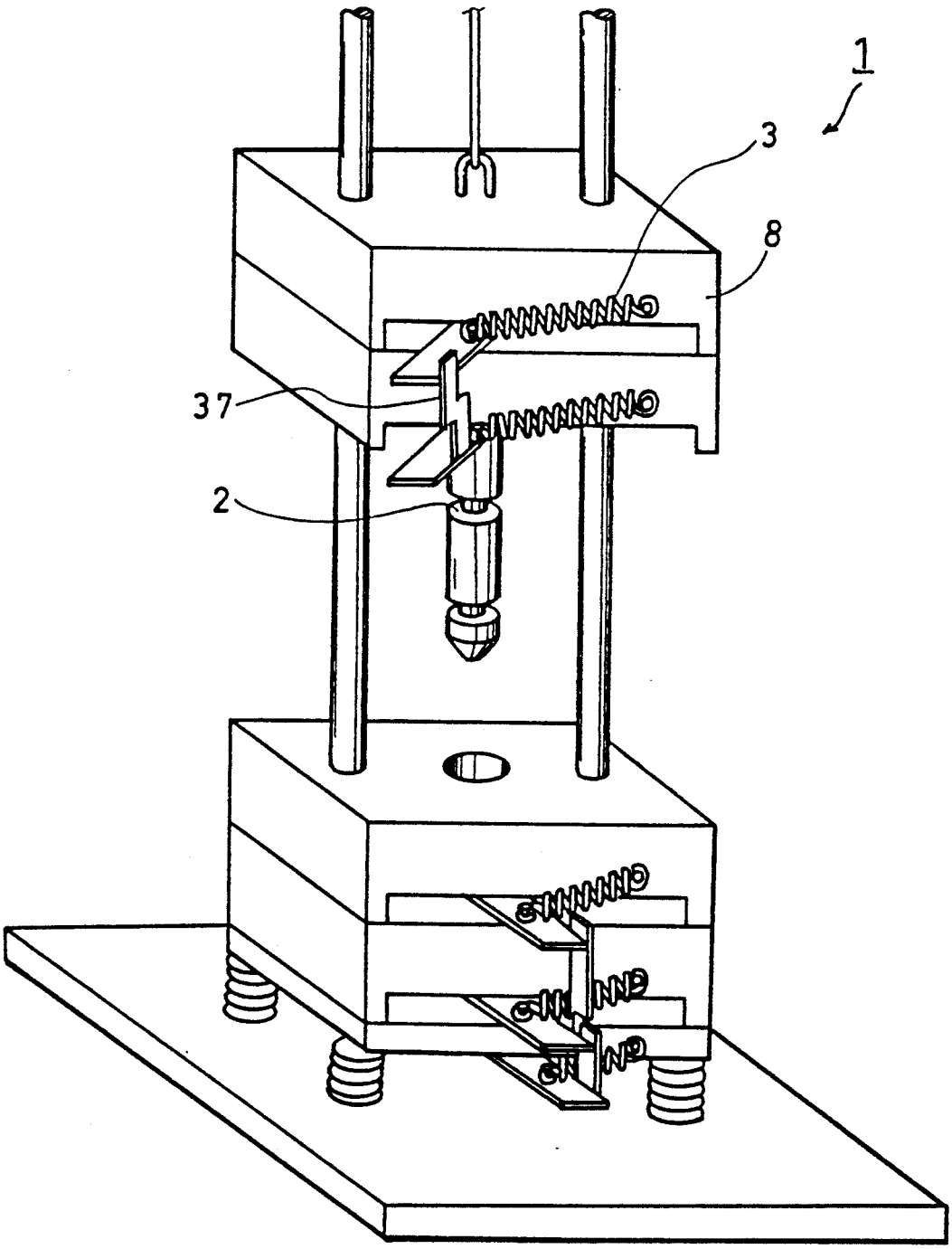
FIG. 3 is a rear and upper right perspective view of the weight adjusting device.
Figure 4:
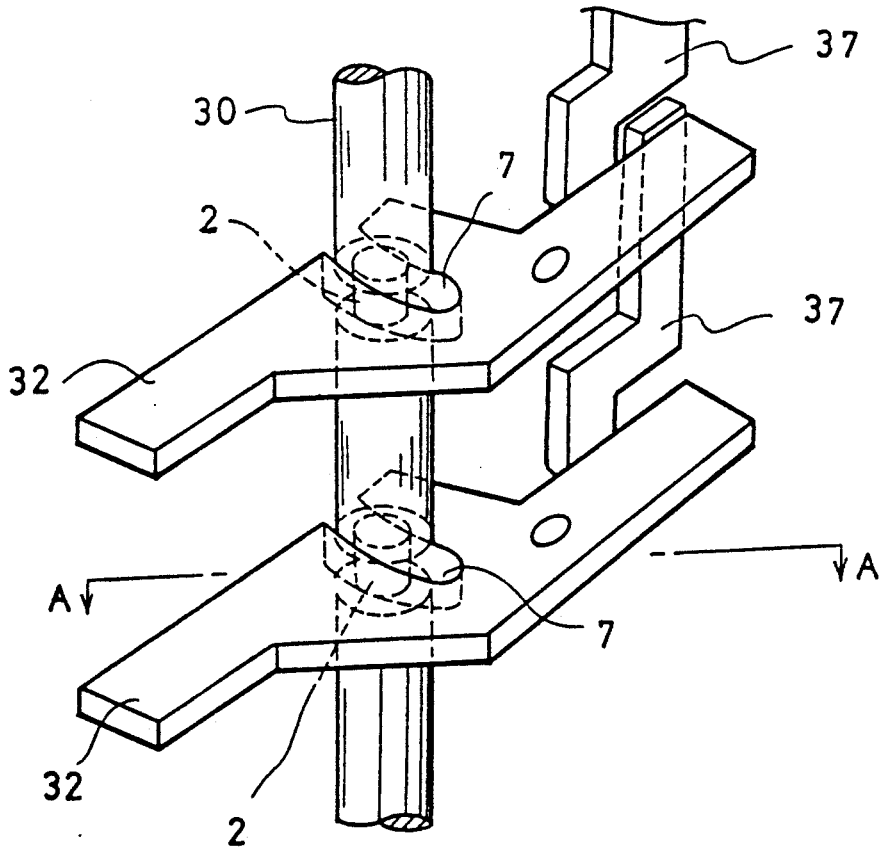
FIG. 4 is a front and upper right perspective view of latch levers for the weight adjusting device.
Figure 5:
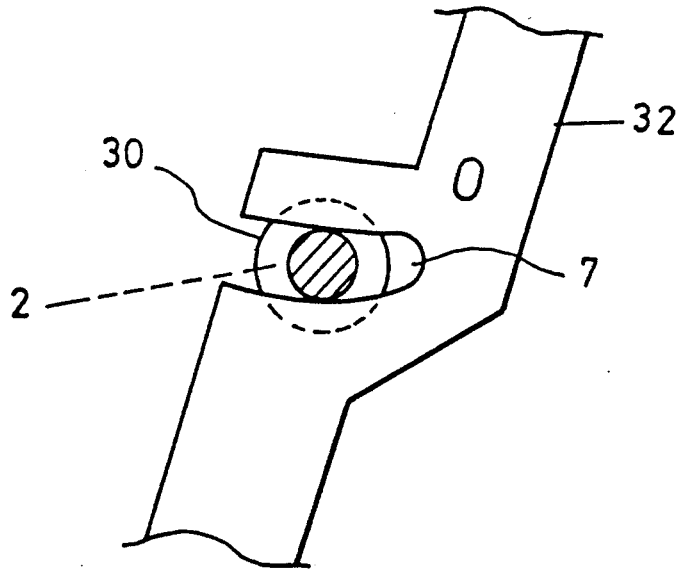
FIG. 5 is a sectional view taken along line A—A of FIG. 4.
Figure 6:
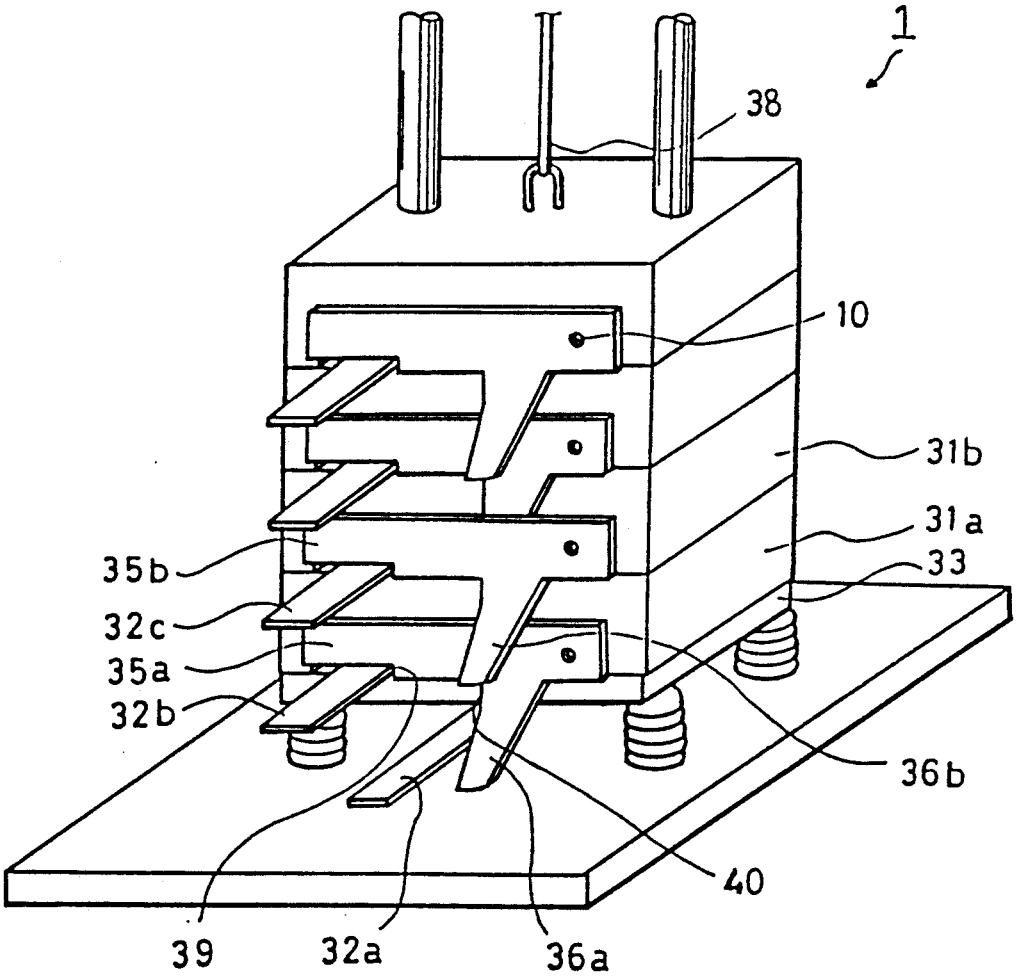
FIG. 6 is a front and upper right perspective view of the weight adjusting device wherein all of the weight plates are fastened to the hanger bar.
Figure 7:
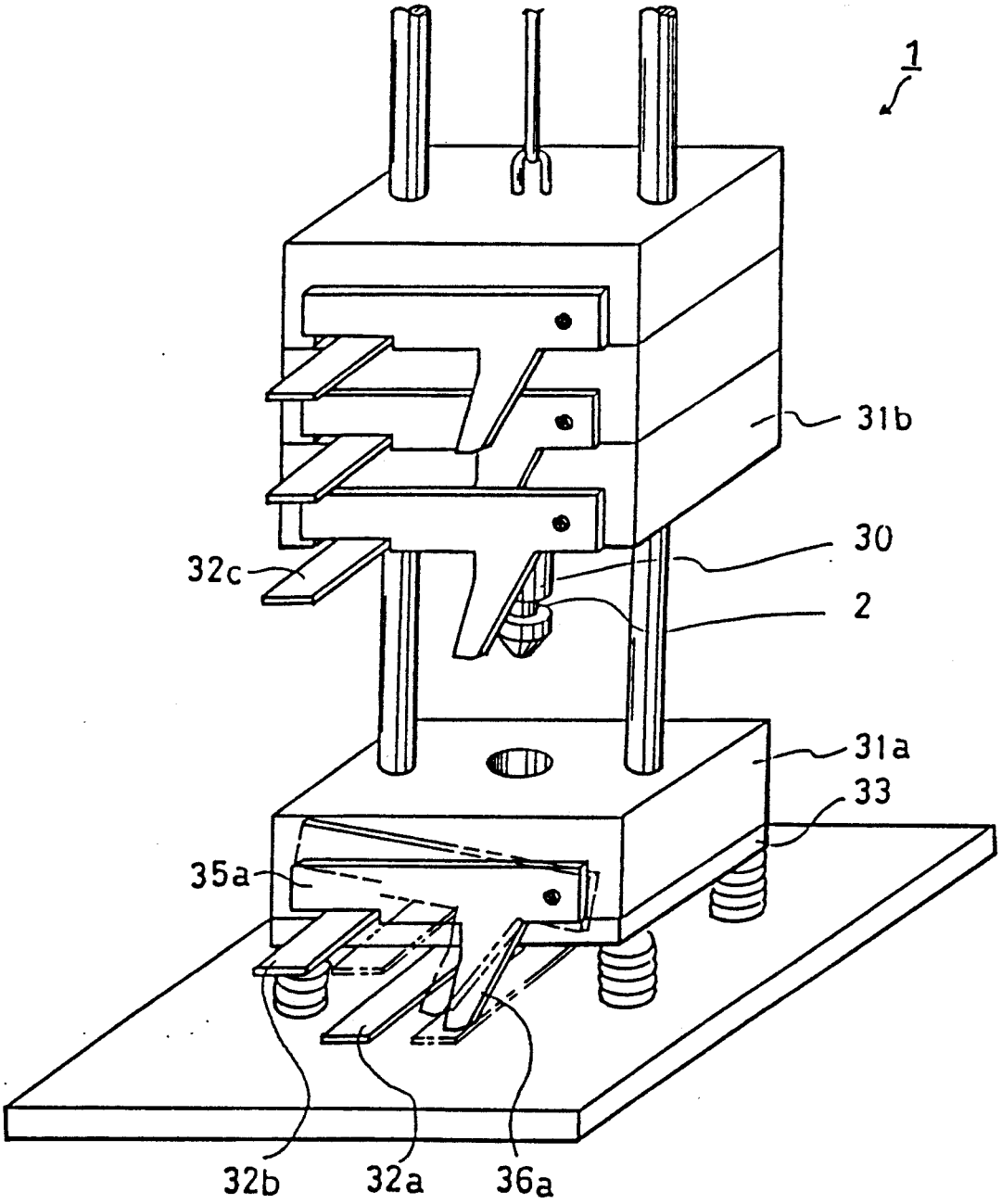
FIG. 7 is a front and upper right perspective view of the weight adjusting device wherein the bottom weight plate is left on the base.
Figure 8:
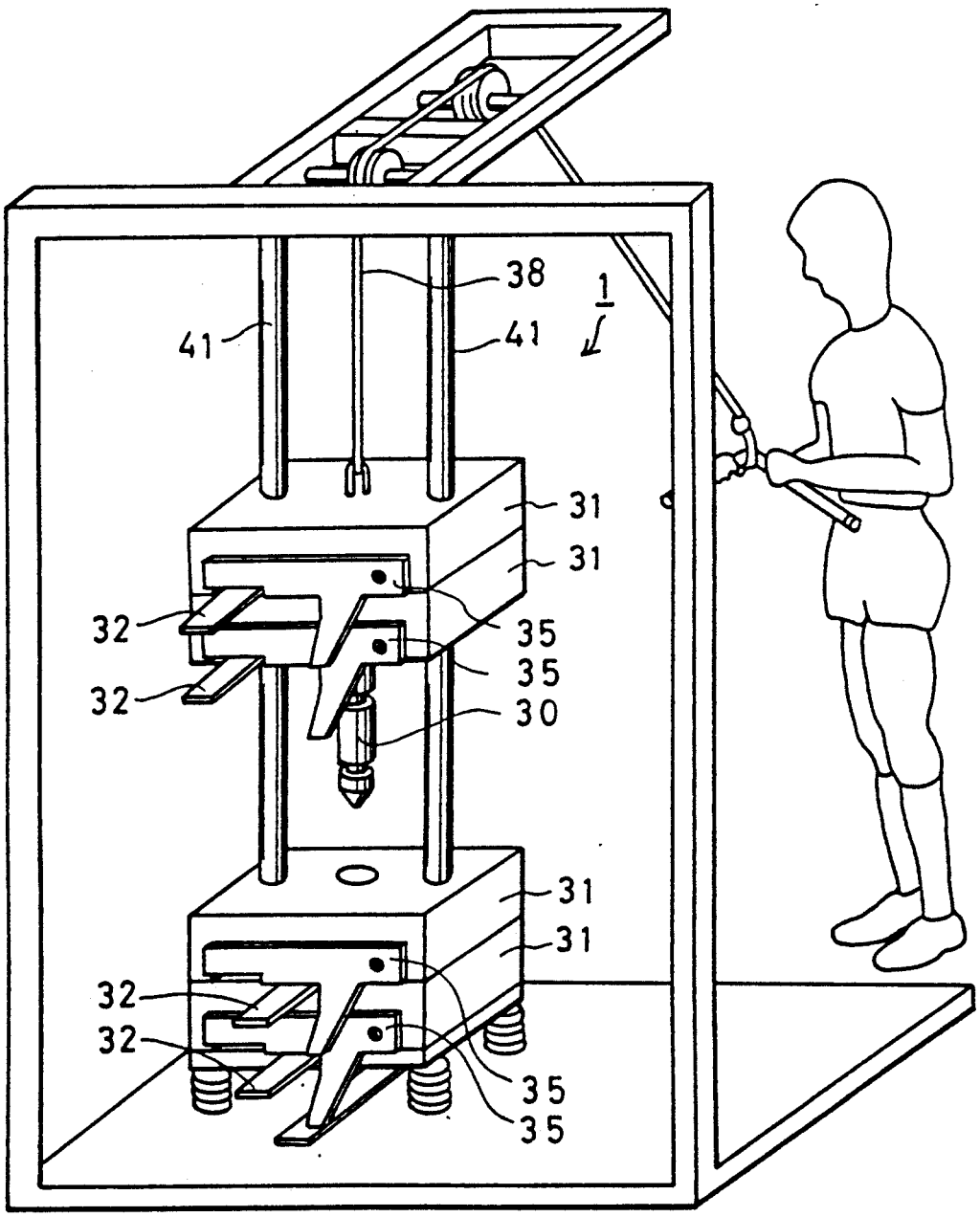
FIG. 8 is a front and upper right perspective view of a muscle training machine which employs the weight adjusting device.

In FIGS. 6-8, in order to fasten the desired number of weight plates 31 to the hanger bar 30, all you have to do is to just manipulate only one of the latch levers 32. For example, if all of the weight plates 31 are hung, the latch lever **32*a* of the base 33 is turned clockwise toward the hanger bar 30 so that the interlocking arm 37 of the latch lever 32*a* turns clockwise the upper latch lever 32*b* against the tension spring 3 toward the hanger bar 30. Consequently, the latch recess 7 of the latch lever 32*b* engages the latch notch 2 on opposite sides of the hanger bar 30. This engagement is made on both sides of the latch notch 2 so that the weight is not offset from the center of gravity of the hanger bar 30. The interlocking arm 37 of the latch lever 32*b* then turns the upper latch lever 32*c* against the tension spring 3 toward the hanger bar 30** for engagement with the latch notch 2. In this way, all of the weight plates 31 are fastened to the hanger bar 30 in balanced conditions, thereby preventing inclination of the weight which causes frictional contact with the guiding posts.

After the latch lever 32*a* is moved toward the hanger bar 30, it is returned by the tension spring 3 to abut on the release portion 36*a* of the lock lever 35*a*. When the weight plate 31*a* is lifted upwardly together with the lock lever 35*a*, the latch lever 32*a* slides past the tip of the release portion 36*b* into the release position beneath the release portion 36*a* of the lock lever 35*a*.

Similarly, when another latch lever 32 is manipulated, the manipulated lever 32 and all the other levers 32 above the manipulated lever 32 engage the hanger bar 30 by means of the interlocking arms 37 to fasten the weight plates 31 to the hanger bar 30. In this way, the desired number of weight plates 31 is set by manipulating only one of the latch levers 32.

In the weight reduction training method, after training the muscles to the limit, the user reduces the pulling force to lower the weight so that the release portion 36*a* of the lowest weight plate 31*a* abuts on the latch lever 32*a* in the release position. When the release portion 36*a* strikes the latch lever 32*a*, the lock arm 35*a* is turned counterclockwise to release the latch lever 32*b* from the first latch shoulder 39 under the influence of the tension spring 3. When the latch lever 32*b* is returned by the tension spring 3, it hits the tip of the release portion 36*b* so that the lock arm 35*b* is urged to rotate counterclockwise, thereby assuring the locking of engagement between the latch lever 32*c* and the hanger bar 30. Thus, the stepwise reduction of weight is effected without any danger that both of the weight plates 31*a* and 31*b* are released accidentally from the hanger bar 30 as in the fore-mentioned conventional device.

Then, when the weight plates 31*b*–31*d* are lifted, the weight plate 31*a* is removed from the hanger bar 30 and remained on the base 33, with the latch lever 32*b* abutting on the second shoulder 40 of the lock lever 35*a* in the release position. Then, when the weight plates 31*b*–31*d* are lowered after the training with the reduced weight so that the release portion 36*b* hits the latch lever 32*b* in the release position, the lock arm 35*b* is turned clockwise. As a result, the above operation is repeated. Then, when the weight plates 31*c* and 31*d* are lifted, the weight plate 31*b* is left on top of the weight plate 31*a*. In this way, the weight is reduced stepwise each time the weight is sufficiently lowered to permit the release portion 36 to hit the latch lever 32.

Alternatively, the leg portions 4 may be replaced by an opening formed through the weight plate 31 to receive the latch lever 32. The leg portions 4 may be provided on the top surface of a weight plate 31, and the latch lever 32 is pivoted to the top surface. The lock members 35 are pivoted to the front face of a weight plate 31 but may be provided so as to slide in the vertical direction.

As has been described above, the weight adjusting device according to the invention is especially useful for the weight reduction training method. With the weight adjusting device, it is possible to reduce stepwise the weight without inclination of the weight and prevent simultaneous release of two or more weight plates by a single release operation. Also, it is possible for the user to manipulate the weight by himself or herself without interruption of the exercise. Since the interlocking arms are provided at right angles with the latch levers, the abutments on the upper latch lever become uniform, thus eliminating the need for fine tuning of the bending angle of the interlocking arms, resulting in the reduced unit manufacturing costs.

I claim:

1. A weight adjusting device for a muscle training machine, comprising:

a hanger bar;

at least one guiding post placed parallel to said hanger bar;

at least one weight plate having a vertical central aperture for receiving said hanger bar and at least one vertical guiding aperture for receiving said guiding post;

a hanging means for lifting said hanger bar;

at least one latch lever attached to said weight plate for rotation in a horizontal plane between a release position where said latch lever disengages said hanger bar and a latch position where said latch lever engages said hanger bar;

at least one lock lever attached to said weight plate for rotation about a fulcrum in a vertical plane between a lock position where a first shoulder thereof engages said latch lever for locking said latch lever in said latch position and an unlock position where said latch lever is released from said first shoulder toward said release position;

at least one spring means placed between said latch lever and said weight plate so as to urge said latch lever toward said release position;

at least one interlocking arm extending upwardly from a rear portion of said latch lever so as contact at right angles with another latch lever placed above said latch lever;

at least one latch notch formed on a circumference of said hanger bar; and at least one latch recess formed on said latch lever so as to engage said latch notch on opposite sides thereof when said latch lever is moved towards said latch position against said spring means, wherein said interlocking arm has such a configuration that is brought into contact with said another latch lever in an area other than a portion of said another latch lever from which another interlocking arm extends upwardly.

2. A weight adjusting device for muscle training machine, comprising:

a hanger bar;

at least one guiding post placed parallel to said hanger bar;

at least one weight plate having a vertical central aperture for receiving said hanger bar and at least one vertical guiding aperture for receiving said guiding post;

a hanging means for lifting said hanger bar;

at least one latch lever attached to said weight plate for rotation in a horizontal plane between a release position where said latch lever disengages said hanger bar and a latch position where said latch lever engages said hanger bar;

at least one lock lever attached to said weight plate for rotation about a fulcrum in a vertical plane between a lock position where a first shoulder thereof engages said latch lever for locking said latch lever in said latch position and an unlock position where said latch lever is released from said first shoulder toward said release position;

at least one spring means placed between said latch lever and said weight plate so as to urge said latch lever toward said release position;

at least one interlocking arm extending upwardly from a rear portion of said latch lever so as contact another latch lever above said latch lever at right angles;

at least one latch notch formed on a circumference of said hanger bar; and at least one latch recess formed on said latch lever so as to engage said latch notch on opposite sides thereof when said latch lever is moved towards said latch position against said spring means, wherein said latch lever has a Z-shaped configuration so as to provide a space sufficiently large for an elongated recess and a large ratio of a distance between said fulcrum and said first shoulder to a distance between said fulcrum and said release portion.

* * * * *